US010119769B2

(12) United States Patent
Yang

(10) Patent No.: US 10,119,769 B2
(45) Date of Patent: Nov. 6, 2018

(54) TRI-PIECE THERMAL ENERGY BODY HEAT EXCHANGER HAVING MULTI-LAYER PIPELINE AND TRANSFERRING HEAT TO EXTERIOR THROUGH OUTER PERIPHERY OF PIPELINE

(71) Applicant: Tai-Her Yang, Dzan-Hwa (TW)

(72) Inventor: Tai-Her Yang, Dzan-Hwa (TW)

( * ) Notice: Subject to any disclaimer, the term of this patent is extended or adjusted under 35 U.S.C. 154(b) by 0 days.

(21) Appl. No.: 15/640,768

(22) Filed: Jul. 3, 2017

(65) Prior Publication Data

US 2017/0299280 A1 Oct. 19, 2017

Related U.S. Application Data

(60) Division of application No. 14/045,051, filed on Oct. 3, 2013, now Pat. No. 9,719,733, which is a continuation-in-part of application No. 13/628,116, filed on Sep. 27, 2012.

(51) Int. Cl.

| | |
|---|---|
| ***F28F 1/00*** | (2006.01) |
| ***F28D 7/10*** | (2006.01) |
| ***F28D 13/00*** | (2006.01) |
| ***F28D 7/00*** | (2006.01) |
| ***F28F 1/36*** | (2006.01) |
| *F28D 9/00* | (2006.01) |
| *F28D 7/02* | (2006.01) |
| *F28D 7/08* | (2006.01) |

(52) U.S. Cl.

CPC ..... *F28F 1/003* (2013.01); *F28D 7/0083* (2013.01); *F28D 7/106* (2013.01); *F28F 1/36* (2013.01); *F28D 7/022* (2013.01); *F28D 7/085* (2013.01); *F28D 9/0093* (2013.01)

(58) Field of Classification Search

CPC F28F 1/003; F28F 1/36; F28D 7/0083; F28D 7/106; F28D 7/022; F28D 7/085; F28D 9/0093; F25B 39/00; F25B 39/04

USPC ..... 165/177, 140, 141, 104.16

See application file for complete search history.

(56) References Cited

U.S. PATENT DOCUMENTS

| | | | |
|---|---|---|---|
| 872,175 | A | 11/1907 | Griesser |
| 1,701,341 | A | 2/1929 | Small |
| 1,738,914 | A | 12/1929 | Mott |
| 1,798,330 | A | 3/1931 | Leek |
| 1,833,876 | A | 11/1931 | McGrath |
| 2,658,728 | A | 11/1953 | Evans, Jr. |
| 2,858,677 | A | 11/1958 | Stone |
| 3,907,028 | A | 9/1975 | Lawson |

(Continued)

FOREIGN PATENT DOCUMENTS

WO WO2008078194 A2 7/2008

*Primary Examiner* — Davis Hwu

(74) *Attorney, Agent, or Firm* — Bacon & Thomas, PLLC

(57) ABSTRACT

The present invention provides a tri-piece thermal energy body heat exchanger having multi-layer pipeline and transferring heat to exterior through outer periphery of pipeline, which is configured by multiple layers of pipelines sleeved with each other, the fluid in the outer layer pipeline covers the inner layer pipeline for exchanging heat with the fluid in the inner layer pipeline, and the fluid in the outer layer pipeline is further used for transferring heat to the solid or fluid state thermal energy body which is in contact with the outer periphery of the outer layer pipeline, thereby forming a three-layer annular tri-piece thermal energy body heat exchanger.

11 Claims, 6 Drawing Sheets

(56) References Cited

U.S. PATENT DOCUMENTS

| | | | | |
|---|---|---|---|---|
| 4,201,191 | A * | 5/1980 | Zink | F17C 9/02 122/33 |
| 7,237,602 | B2 | 7/2007 | Arai et al. | |
| 9,719,733 | B2 * | 8/2017 | Yang | F28F 1/003 |
| 2009/0217700 | A1 * | 9/2009 | Khrustalev | F25B 39/04 62/498 |
| 2012/0285190 | A1 * | 11/2012 | Lee | F25B 39/00 62/238.6 |

* cited by examiner

TRI-PIECE THERMAL ENERGY BODY HEAT EXCHANGER HAVING MULTI-LAYER PIPELINE AND TRANSFERRING HEAT TO EXTERIOR THROUGH OUTER PERIPHERY OF PIPELINE

CROSS REFERENCE TO RELATED APPLICATION

This is a Divisional of application Ser. No. 14/045,051 file on Oct. 3, 2013, which is a Continuation-In-Part of application Ser. No. 13/628,116 filed on Sep. 27, 2012.

BACKGROUND OF THE INVENTION

(a) Field of the Invention

The present invention provides a tri-piece thermal energy body heat exchanger having multi-layer pipeline and transferring heat to exterior through outer periphery of pipeline, which is configured by multiple layers of pipelines sleeved with each other, the fluid in the outer layer pipeline covers the inner layer pipeline for exchanging heat with the fluid in the inner layer pipeline, and the fluid in the outer layer pipeline is further used for transferring heat to the solid or fluid state thermal energy body which is in contact with the outer periphery of the outer layer pipeline, thereby forming a three-layer annular tri-piece thermal energy body heat exchanger.

(b) Description of the Prior Art

In a conventional heat exchanger which utilizes the outer layer of a pipeline for transferring heat to the exterior, the temperature equalization is often performed through the fluid passing the pipeline and the fluid passing the outer layer of the pipeline, or with the solid member or fluid which is in contact with the outer layer of pipeline, therefore only a two-piece thermal energy body heat exchanger can be formed.

SUMMARY OF THE INVENTION

The configuration of the present invention is that an inner layer pipeline having a relatively smaller outer diameter is adopted as a first flow guiding pipe member (101), the first flow guiding pipe member (101) is made of a heat conductive member, and the pipe hole of the first flow guiding pipe member (101) is formed as a first flow path (102), two ends of the first flow path (102) are respectively leaded to a first flow gathering chamber (103) and a first fluid inlet/outlet port (104), thereby allowing a first thermal energy body (105) formed in a fluid state to flow in or flow out; and an outer layer pipeline having an inner diameter larger than the outer diameter of the first flow path (102) is adopted as a second flow guiding pipe member (201) thereby forming a structure having two layers of pipelines, the second flow guiding pipe member (201) is made of a heat conductive member, and the diameter difference defined between the larger inner diameter of the second flow guiding pipe member (201) and the outer diameter of the first flow guiding pipe member (101) forms a second flow path (202) having an annular cross section, two ends of the second flow path (202) are respectively through a second flow gathering chamber (203) and a second fluid inlet/outlet port (204), thereby allowing a second thermal energy body (205) formed in a fluid state to flow in and flow out, wherein the outer periphery of the outer layer pipeline of the second flow path (202) is in contact with a natural thermal energy body formed by stratum, earth soil, ocean, river, lake, pond, flowing fluid, atmosphere, or flowing air, or the thermal energy body formed by the fluid artificially installed in the sink, pool or container, said thermal energy body including formed in gaseous, liquid or solid state thermal energy body is served as a third thermal energy body (305), thereby forming the function of three-layer annular tri-piece thermal energy body heat exchange, so the heat exchanging and transferring can be performed among the second thermal energy body (205) and the first thermal energy body (105) and the third thermal energy body (305).

DESCRIPTION OF MAIN COMPONENT SYMBOLS

Figure 2:
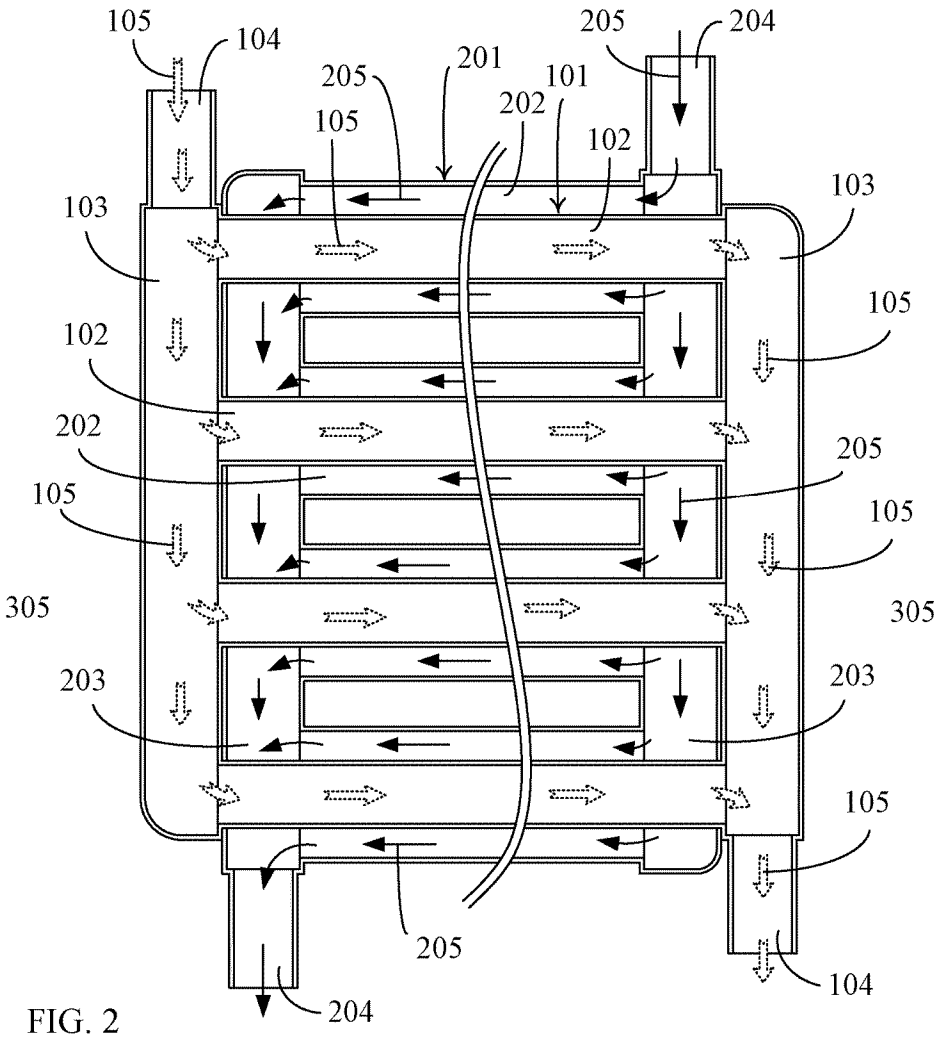
FIG. 2 is a lateral cross sectional view showing the main structure disclosed in FIG. 1.

101: first flow guiding pipe member
102: first flow path
103: first flow gathering chamber
104: first fluid inlet/outlet port
105: first thermal energy body

111, 222: spiral flow guiding sheet
201: second flow guiding pipe member
202: second flow path
203: second flow gathering chamber
204: second fluid inlet/outlet port
205: second thermal energy body
305: third thermal energy body
400: fluid pump
1000: heat conduction fin

DETAILED DESCRIPTION OF THE PREFERRED EMBODIMENTS

In a conventional heat exchanger which utilizes the outer layer of a pipeline for transferring heat to the exterior, the temperature equalization is often performed through the fluid passing the pipeline and the fluid passing the outer layer of the pipeline, or with the solid member or fluid which is in contact with the outer layer of pipeline, therefore only a two-piece thermal energy body heat exchanger can be formed.

The present invention provides a tri-piece thermal energy body heat exchanger having multi-layer pipeline and transferring heat to exterior through outer periphery of pipeline, which is configured by multiple layers of pipelines sleeved with each other, the fluid in the outer layer pipeline covers the inner layer pipeline for exchanging heat with the fluid in the inner layer pipeline, and the fluid in the outer layer pipeline is further used for transferring heat to the solid or fluid state thermal energy body which is in contact with the outer periphery of the outer layer pipeline, thereby forming a three-layer annular tri-piece thermal energy body heat exchanger.

The configuration of the present invention is that an inner layer pipeline having a relatively smaller outer diameter is adopted as a first flow guiding pipe member (101), the first flow guiding pipe member (101) is made of a heat conductive member, and the pipe hole of the first flow guiding pipe member (101) is formed as a first flow path (102), two ends of the first flow path (102) are respectively leaded to a first flow gathering chamber (103) and a first fluid inlet/outlet port (104), thereby allowing a first thermal energy body (105) formed in a fluid state to flow in or flow out; and an outer layer pipeline having an inner diameter larger than the outer diameter of the first flow path (102) is adopted as a second flow guiding pipe member (201) thereby forming a structure having two layers of pipelines, the second flow guiding pipe member (201) is made of a heat conductive member, and the diameter difference defined between the larger inner diameter of the second flow guiding pipe member (201) and the outer diameter of the first flow guiding pipe member (101) forms a second flow path (202) having an annular cross section, two ends of the second flow path (202) are respectively leaded to a second flow gathering chamber (203) and a second fluid inlet/outlet port (204), thereby allowing a second thermal energy body (205) formed in a fluid state to flow in and flow out, wherein the outer periphery of the outer layer pipeline of the second flow path (202) is in contact with a natural thermal energy body formed by stratum, earth soil, ocean, river, lake, pond, flowing fluid, atmosphere, or flowing air, or the thermal energy body formed by the fluid artificially installed in the sink, pool or container, said thermal energy body including formed in gaseous, liquid or solid state thermal energy body is served as a third thermal energy body (305), thereby forming the function of three-layer annular tri-piece thermal energy body heat exchange, so the heat exchanging and transferring can be performed among the second thermal energy body (205) and the first thermal energy body (105) and the third thermal energy body (305).

Figure 1:
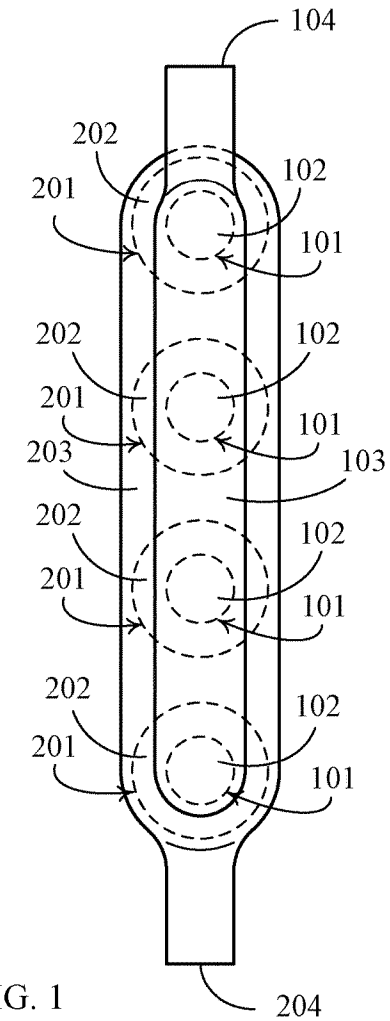
FIG. 1 is a front view showing the main structure according to one embodiment of the present invention.

The main configuration is illustrated as followings:

FIG. 1 is a front view showing the main structure according to one embodiment of the present invention;

FIG. 2 is a lateral cross sectional view showing the main structure disclosed in FIG. 1;

According to the tri-piece thermal energy body heat exchanger having multi-layer pipeline and transferring heat to exterior through outer periphery of pipeline shown in FIG. 1 and FIG. 2, the main configuration is provided with a first flow guiding pipe member (101) of one or more than one route, the first flow guiding pipe member (101) is made of a heat conductive member, and the pipe hole of the first flow guiding pipe member (101) is formed as a first flow path (102), two ends of the first flow path (102) are respectively through a first flow gathering chamber (103) and a first fluid inlet/outlet port (104), thereby allowing a first thermal energy body (105) formed in a fluid state to flow in or flow out; and the exterior of the first flow guiding pipe member (101) is sleeved and installed with the second flow guiding pipe member (201) of one or more than one route having an inner diameter larger than the outer diameter of the first flow guiding pipe member (101), thereby forming a structure having two layers of pipelines, the second flow guiding pipe member (201) is made of a heat conductive member, and the diameter difference defined between the larger inner diameter of the second flow guiding pipe member (201) and the outer diameter of the first flow guiding pipe member (101) forms a second flow path (202) having an annular cross section, two ends of the second flow path (202) are respectively through a second flow gathering chamber (203) and a second fluid inlet/outlet port (204), thereby allowing a second thermal energy body (205) formed in a fluid state to flow in and flow out, wherein the outer layer of the second flow guiding pipe member (201) is in contact with a third thermal energy body (305) formed in a gaseous or liquid state or a solid thermal energy body, thereby forming a three-layer annular tri-piece thermal energy body heat exchanger, so the heat exchanging and transferring can be performed among the second thermal energy body (205) and the first thermal energy body (105) and the third thermal energy body (305);

- the mentioned first flow guiding pipe member (101) and the second flow guiding pipe member (201) can be formed in one or more than one route;
- the mentioned first flow guiding pipe member (101) and the second flow guiding pipe member (201) can be configured by pipe members formed in circular or rectangular or oval or other geometric shapes;
- the mentioned first flow guiding pipe member (101) and the second flow guiding pipe member (201) can be configured by pipe members having the same or different shapes;
- the mentioned first thermal energy body (105) and the second thermal energy body (205) can be formed by the same or different fluids, including formed by the gaseous or liquid fluid or the fluid capable of converting into a gaseous state from a liquid state or converting into a liquid state from a gaseous state;
- the flow direction of the first thermal energy body (105) flowing in the first flow guiding pipe member (101) and the flow direction of the second thermal energy body (205) flowing in the second flow guiding pipe member (201) can be the same or different.

Figure 4:
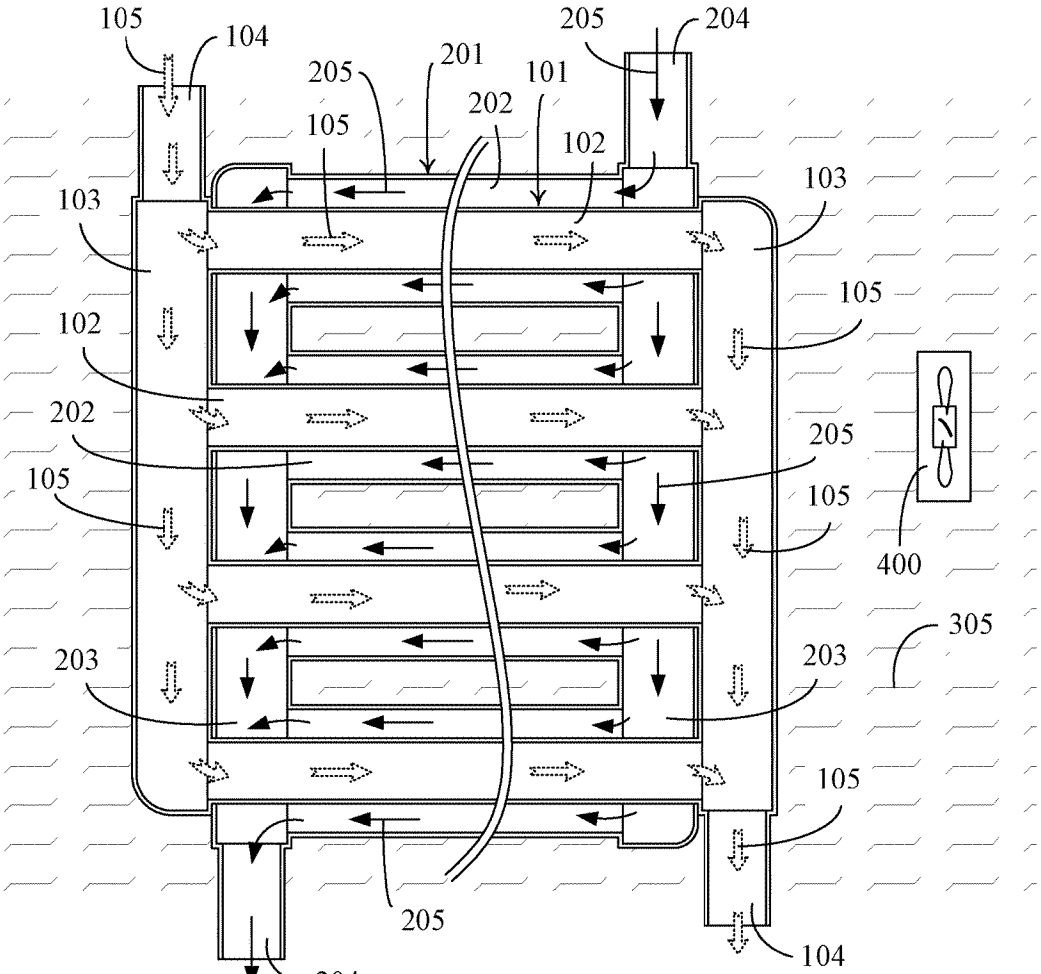
FIG. 4 is a lateral cross sectional view showing the main structure disclosed in FIG. 3.
Figure 3:
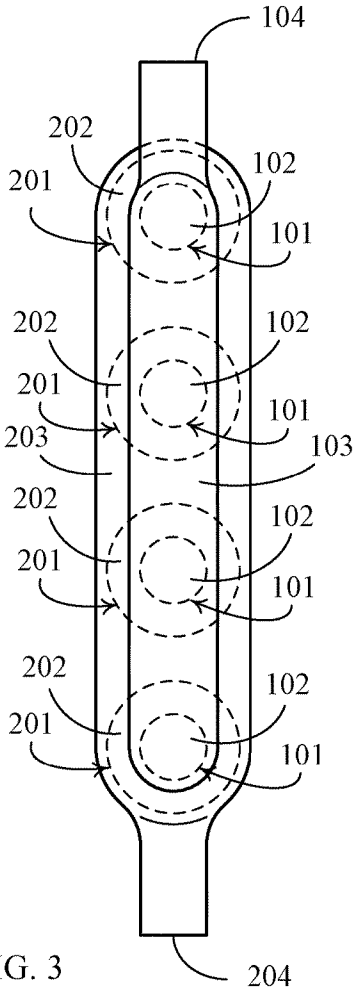
FIG. 3 is a front view illustrating the third thermal energy body disclosed in the embodiment shown FIG. 1 being formed in a fluid state and a fluid pump being installed.

According to tri-piece thermal energy body heat exchanger having multi-layer pipeline and transferring heat to exterior through outer periphery of pipeline, when the third thermal energy body (305) is formed by gaseous or liquid fluid, a fluid pump (400) can be additionally installed for pumping the third thermal energy body (305) thereby enhancing the heat exchange effect;

FIG. 3 is a front view illustrating the third thermal energy body disclosed in the embodiment shown FIG. 1 being formed in a fluid state and a fluid pump being installed;

FIG. 4 is a lateral cross sectional view showing the main structure disclosed in FIG. 3;

As shown in FIG. 3 and FIG. 4, the fluid pump (400) is additionally installed for pumping the fluid (305) thereby enhancing the heat exchange effect.

Figure 5:
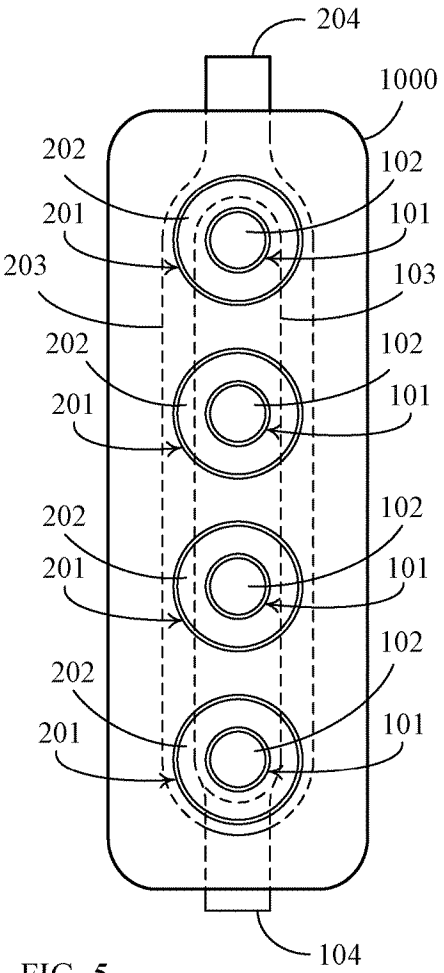
FIG. 5 is a frontal cross sectional view showing the embodiments shown in FIG. 1 and FIG. 2 being additionally installed with a heat conduction fin (1000).

FIG. 5 is a frontal cross sectional view showing the embodiments shown in FIG. 1 and FIG. 2 being additionally installed with a heat conduction fin (1000).

Figure 6:
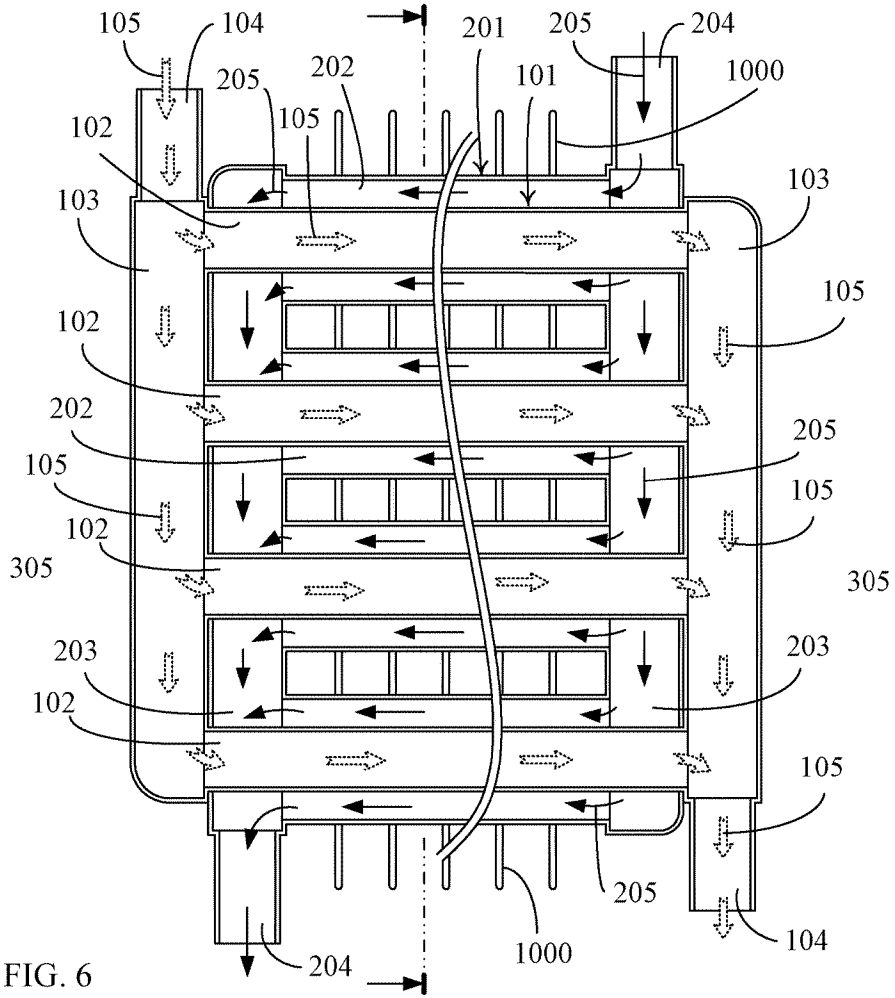
FIG. 6 is a lateral cross sectional view showing the main structure disclosed in FIG. 5.

FIG. 6 is a lateral cross sectional view showing the main structure disclosed in FIG. 5.

As shown in FIG. 5 and FIG. 6, the second flow guiding pipe member (201) in the embodiments of FIG. 1 and FIG. 2 is further installed with a heat conduction fin (1000) for transferring the thermal energy between the second flow guiding pipe member (201) and the third thermal energy body (305).

Figure 8:
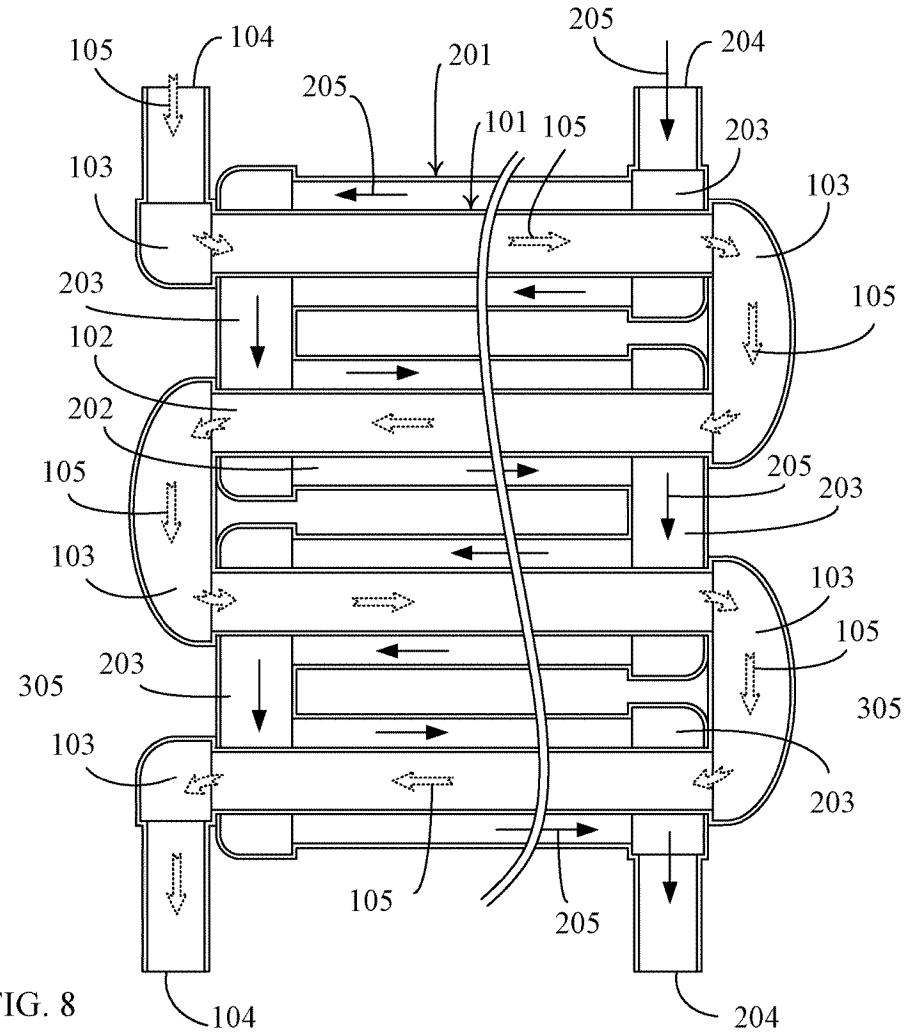
FIG. 8 is a lateral cross sectional view showing the main structure disclosed in FIG. 7.
Figure 7:
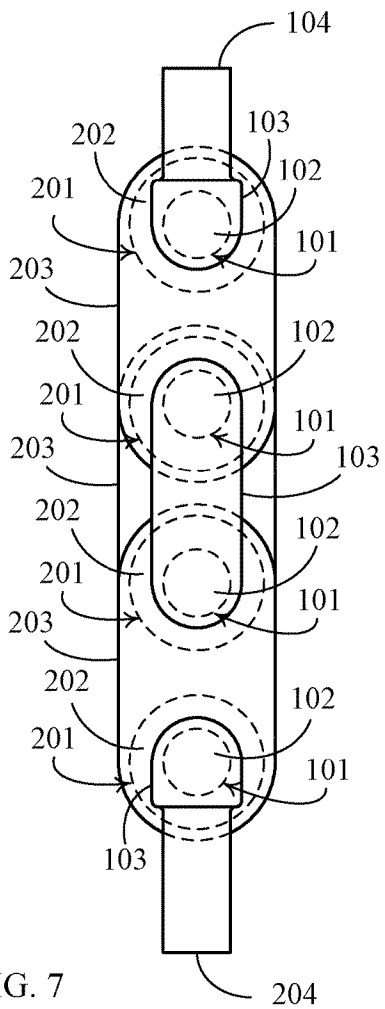
FIG. 7 is a front view illustrating each section of the first flow guiding pipe member (101) disclosed in the embodiments shown FIG. 1 and FIG. 2 being connected in series, and each section the first flow path (102) disclosed in the embodiments shown FIG. 1 and FIG. 2 being connected in series also.

According to the tri-piece thermal energy body heat exchanger having multi-layer pipeline and transferring heat to exterior through outer periphery of pipeline of the present invention, each section of the first flow guiding pipe member (101) and/or the second flow guiding pipe member (201) shown in FIG. 1 and FIG. 2 except for being connected in parallel, the first flow guiding pipe member (101) and the second flow guiding pipe member (201) can also be connected in serial; the detail description is as follows:

FIG. 7 is a front view illustrating each section of the first flow guiding pipe member (101) disclosed in the embodiments shown in FIG. 1 and FIG. 2 being connected in series, and each section of the second flow guiding pipe member (201) which is sleeved and installed at the exterior of the first flow guiding pipe member (101) disclosed in the embodiments shown in FIG. 1 and FIG. 2 being connected in series also;

FIG. 8 is a lateral cross sectional view showing the main structure disclosed in FIG. 7.

As shown in FIG. 7 and FIG. 8, each section of the first flow guiding pipe member (101) disclosed in the embodiments shown FIG. 1 and FIG. 2 is made to connect in serial, and each section of the second flow guiding pipe member (201) which is sleeved and installed at the exterior of the first flow guiding pipe member (101) disclosed in the embodiments shown in FIG. 1 and FIG. 2 is made to connect in series also, the first flow guiding pipe member (101) is made of a heat conductive member, the first flow path (102) is connected in series with the first flow path (102) of at least one first flow guiding pipe member (101) through the first flow gathering chamber (103), two ends of the series-connected first flow path (102) are respectively leaded to a first fluid inlet/outlet port (104), thereby allowing a first thermal energy body (105) formed in a fluid state to flow in or flow out; and the second flow guiding pipe member (201) having an inner diameter larger than the outer diameter of the first flow guiding pipe member (101) is sleeved and installed at the exterior of the first flow guiding pipe member (101), thereby forming a structure having two layers of pipelines, the second flow guiding pipe member (201) is made of a heat conductive member, and the diameter difference defined between the larger inner diameter of the second flow guiding pipe member (201) and the outer diameter of the first flow guiding pipe member (101) forms a second flow path (202) having an annular cross section, the second flow path (202) is connected in series with the second flow path (202) of at least one second flow guiding pipe member (201) through the second flow gathering chamber (203), then two ends of the series-connected second flow path (202) are respectively leaded to a second fluid inlet/outlet port (204), thereby allowing a second thermal energy body (205) formed in a fluid state to flow in and flow out, wherein the outer layer of the second flow guiding pipe member (201) is in contact with a third thermal energy body (305) formed in a gaseous or liquid state or a solid thermal energy body, thereby forming a three-layer annular tri-piece thermal energy body heat exchanger, so the heat exchanging and transferring can be performed among the second thermal energy body (205) and the first thermal energy body (105) and the third thermal energy body (305).

Figure 10:
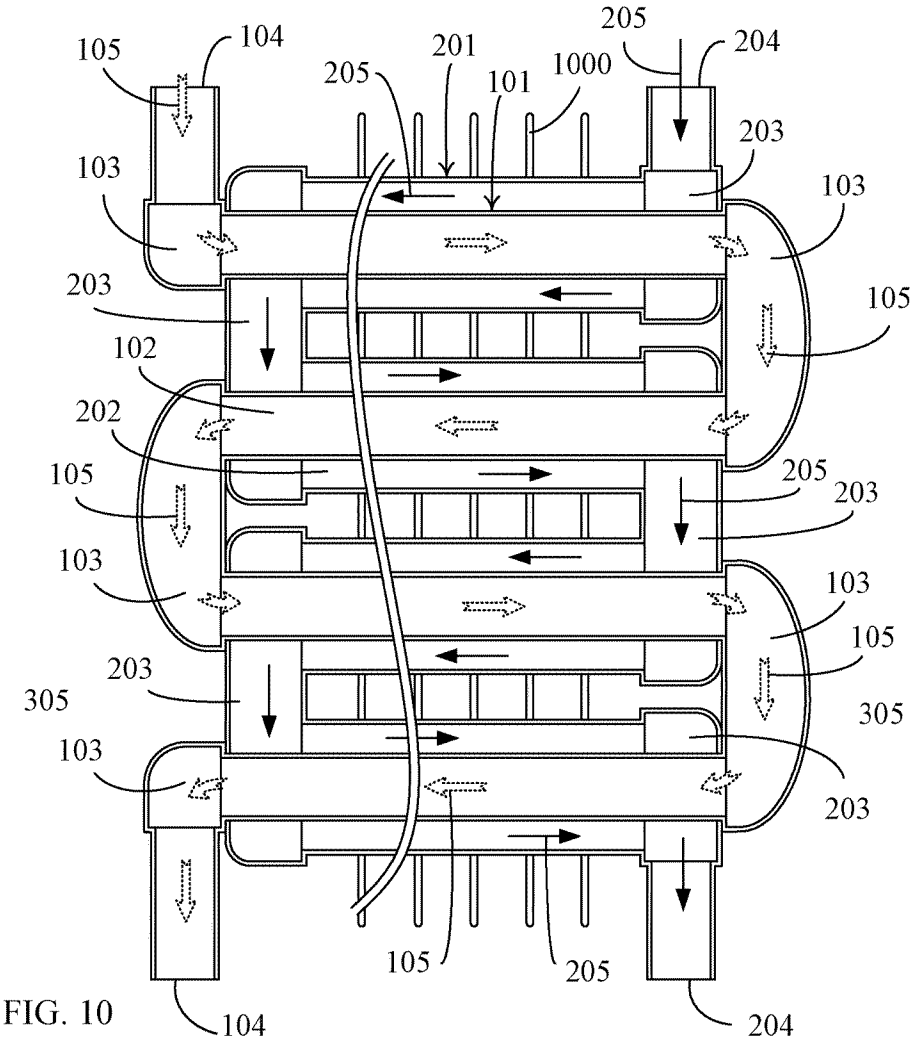
FIG. 10 is a lateral cross sectional view showing the main structure disclosed in FIG. 10.
Figure 9:
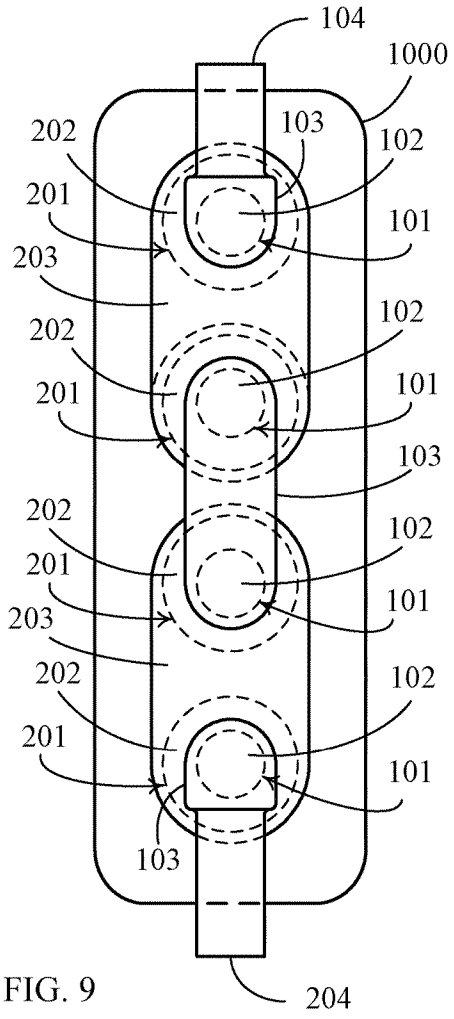
FIG. 9 is a front view illustrating each section of the first flow guiding pipe member (101) disclosed in the embodiments shown FIG. 5 and FIG. 6 being connected in series, and each section the first flow path (102) disclosed in the embodiments shown FIG. 5 and FIG. 6 being connected in series also.

FIG. 9 is a front view illustrating each section of the first flow guiding pipe member (101) disclosed in the embodiments shown in FIG. 5 and FIG. 6 being connected in series, and each section of the second flow guiding pipe member (201) which is sleeved and installed at the exterior of the first flow guiding pipe member (101) disclosed in the embodiments shown in FIG. 5 and FIG. 6 being connected in series also;

FIG. 10 is a lateral cross sectional view showing the main structure disclosed in FIG. 10.

As shown in FIG. 9 and FIG. 10, each section of the first flow guiding pipe member (101) disclosed in the embodiments shown FIG. 5 and FIG. 6 is made to connect in serial, and each section of the second flow guiding pipe member (201) which is sleeved and installed at the exterior of the first flow guiding pipe member (101) disclosed in the embodiments shown in FIG. 5 and FIG. 6 is made to connect in series also.

Figure 11:
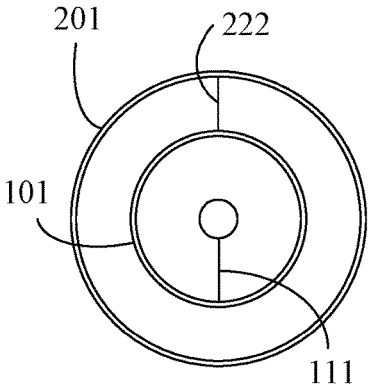
FIG. 11 is a front view of the embodiment illustrating the first flow guiding pipe member (101) and/or the first flow path (102) is installed within a spiral flow guiding sheet in the same spiral flowing direction.

According to the tri-piece thermal energy body heat exchanger having multi-layer pipeline and transferring heat to exterior through outer periphery of pipeline of the present invention, a spiral flow guiding sheet (222) is further formed between the exterior of the first flow guiding pipe member (101) and the interior of the second flow guiding pipe member (201) and/or a spiral flow guiding sheet (111) is further formed at the interior of the first flow guiding pipe member (101), so as to enhance the heat transfer effect; the detailed description is as follows:

FIG. 11 is a front view of the embodiment illustrating a spiral flow guiding sheet structure (222) in the same spiral flowing direction is installed between the exterior of the first flow guiding pipe member (101) and the interior of the second flow guiding pipe member (201) and/or a spiral flow guiding sheet structure (111) in the same spiral flowing direction is installed at the interior of the first flow guiding pipe member (101).

Figure 12:
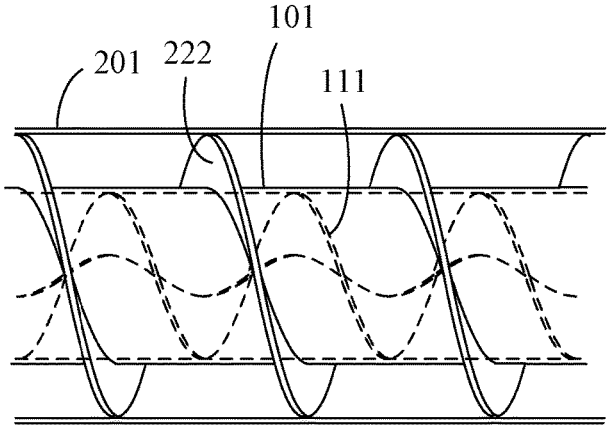
FIG. 12 is a lateral cross sectional view showing the main structure disclosed in FIG. 11.

FIG. 12 is a lateral cross sectional view showing the main structure disclosed in FIG. 11.

As shown in FIG. 11 and FIG. 12, a spiral flow guiding sheet structure (222) in the same spiral flowing direction is installed between the exterior of the first flow guiding pipe member (101) and the interior of the second flow guiding pipe member (201) and/or a spiral flow guiding sheet structure (111) in the same spiral flowing direction is installed at the interior of the first flow guiding pipe member (101).

Figure 13:
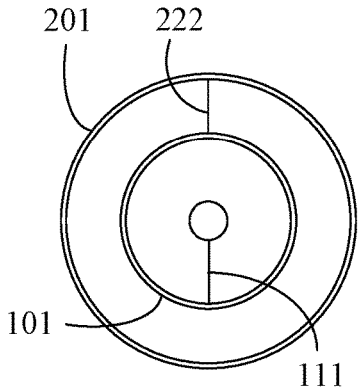
FIG. 13 is a front view of the embodiment illustrating the first flow guiding pipe member (101) and/or the first flow path (102) is installed within a spiral flow guiding sheet in different spiral flowing direction.

FIG. 13 is a front view of the embodiment illustrating a spiral flow guiding sheet structure (222) in different spiral flowing direction is installed between the exterior of the first flow guiding pipe member (101) and the interior of the second flow guiding pipe member (201) and/or a spiral flow guiding sheet structure (222) in different spiral flowing direction is installed at the interior of the first flow guiding pipe member (101).

Figure 14:
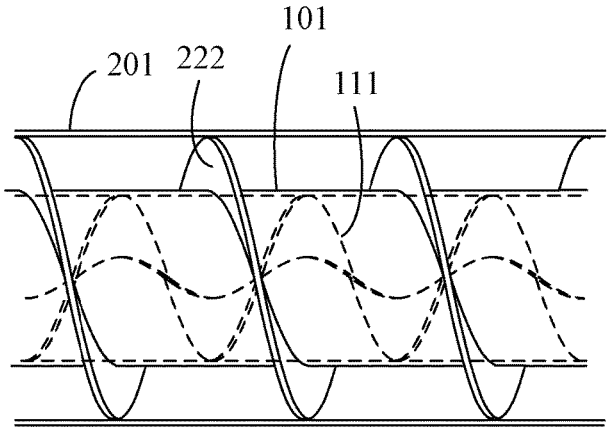
FIG. 14 is a lateral cross sectional view showing the main structure disclosed in FIG. 13.

FIG. 14 is a lateral cross sectional view showing the main structure disclosed in FIG. 13.

As shown in FIG. 13 and FIG. 14, a spiral flow guiding sheet structure (222) in different spiral flowing direction is installed between the exterior of the first flow guiding pipe member (101) and the interior of the second flow guiding pipe member (201) and/or a spiral flow guiding sheet structure (222) in different spiral flowing direction is installed at the interior of the first flow guiding pipe member (101).

The invention claimed is:

1. A tri-piece thermal energy body heat exchanger having multi-layer pipeline and transferring heat to exterior through outer periphery of pipeline comprising:

a first flow path (102) that includes first flow gathering chambers (103) respectively connected to a first upper fluid inlet/outlet port (104) at an upper end of the heat exchanger and a first lower fluid inlet/outlet port (104) at a lower end of the heat exchanger, and a plurality of a first flow guiding pipe members (101) connected in parallel between the first flow gathering chambers (103), whereby a first thermal energy body (105) formed in a fluid state flows from one of the first lower and upper fluid inlet/outlet ports (104) to one of the first flow gathering chambers (103), then in parallel from the one of the first flow gathering chambers (103) through the first flow guiding pipe members (101) to the other of the first flow gathering chambers (103), then through the other of the first lower and upper fluid inlet/outlet ports (104);

a second flow path (202) that includes second flow gathering chambers (203) respectively connected to a second upper fluid inlet/outlet port (204) at the upper end of the heat exchanger and a second lower fluid inlet/outlet port (204) at the lower end of the heat exchanger, and a plurality of a second flow guiding pipe members (201), wherein the second flow guiding pipe members (201) have an inner diameter larger than an outer diameter of the first flow guiding pipe members (101), the second flow guiding pipe members (201) being sleeved and installed at the exterior of the first flow guiding pipe members (101) such that the first flow guiding pipe members (101) and the second flow guiding pipe members (201) form a structure having two layers of pipelines, and the diameter difference defined between the inner diameter of the second flow guiding pipe members (201) and the outer diameter of the first flow guiding pipe members (101) form parallel connections between the second flow gathering chambers (203), the parallel connections having an annular cross section, whereby a second thermal energy body (205) formed in a fluid state flows from one of the second lower and upper fluid inlet/outlet ports (204) to one of the second flow gathering chambers (203), then in parallel from the one of the second flow gathering chambers (203) through the parallel connections formed between the first flow guiding pipe members (101) and the second flow guiding pipe members (201) to the other of the second flow gathering chambers (203), then through the other of the second lower and upper fluid inlet/outlet ports (204);

wherein respective outer layers of the second flow guiding pipe members (201) are in contact with a third thermal energy body (305) formed in a gaseous or liquid state or a solid thermal energy body, thereby forming a three-layer annular tri-piece thermal energy body heat exchanger, so that the heat exchanging and transferring is performed among the second thermal energy body (205) and the first thermal energy body (105) and the third thermal energy body (305).

2. A tri-piece thermal energy body heat exchanger having multi-layer pipeline and transferring heat to exterior through outer periphery of pipeline as claimed in claim 1, wherein the flow directions of the first thermal energy body (105) flowing in the first flow guiding pipe members (101) and the flow direction of the second thermal energy body (205) flowing in the annular cross-section between the first flow guiding members (101) and the second flow guiding pipe members (201) are the same or different.

3. A tri-piece thermal energy body heat exchanger having multi-layer pipeline and transferring heat to exterior through outer periphery of pipeline as claimed in claim 1, wherein the first flow guiding pipe members (101) and the second flow guiding pipe members (201) are configured by pipe members having the same or different shapes.

4. A tri-piece thermal energy body heat exchanger having multi-layer pipeline and transferring heat to exterior through outer periphery of pipeline as claimed in claim 1, wherein the first thermal energy body (105) and the second thermal energy body (205) are formed by the same or different fluids.

5. A tri-piece thermal energy body heat exchanger having multi-layer pipeline and transferring heat to exterior through outer periphery of pipeline as claimed in claim 1, wherein the first thermal energy body (105) and the second thermal energy body (205) are respectively in one of a gaseous or liquid state, or capable of being converted into a gaseous state from a liquid state or converted into a liquid state from a gaseous state.

6. A tri-piece thermal energy body heat exchanger having multi-layer pipeline and transferring heat to exterior through outer periphery of pipeline as claimed in claim 1, wherein the third thermal energy body (305) is formed by a fluid or solid member.

7. A tri-piece thermal energy body heat exchanger having multi-layer pipeline and transferring heat to exterior through outer periphery of pipeline as claimed in claim 1, wherein when the third thermal energy body (305) is formed by fluid, a fluid pump (400) is additionally installed for pumping the third thermal energy body (305) thereby enhancing the heat exchange effect.

8. A tri-piece thermal energy body heat exchanger having multi-layer pipeline and transferring heat to exterior through outer periphery of pipeline as claimed in claim 1, wherein at least one of the second flow guiding pipe members (201) is further installed with a heat conduction fin (1000).

9. A tri-piece thermal energy body heat exchanger having multi-layer pipeline and transferring heat to exterior through outer periphery of pipeline as claimed in claim 1, wherein a spiral flow guiding sheet (222) is further formed between an exterior of at least one of the first flow guiding pipe members (101) and an interior of at least one of the second flow guiding pipe members (201) and/or a spiral flow guiding sheet (111) is further formed at the interior of the at least one of the first flow guiding pipe members (101), so as to enhance the heat transfer effect.

10. A tri-piece thermal energy body heat exchanger having multi-layer pipeline and transferring heat to exterior through outer periphery of pipeline as claimed in claim 9, wherein a first spiral flow guiding sheet structure (222) is installed between the exterior of the at least one of the first flow guiding pipe members (101) and the interior of the at least one of the second flow guiding pipe members (201) and a second spiral flow guiding sheet structure (111) is installed at the interior of the at least one of the first flow guiding pipe member (101), wherein the first spiral flow guiding sheet structure (222) and the second spiral flow guiding sheet structure (111) have a same spiral direction.

11. A tri-piece thermal energy body heat exchanger having multi-layer pipeline and transferring heat to exterior through outer periphery of pipeline as claimed in claim 9, wherein a first spiral flow guiding sheet structure (222) is installed between the exterior of the at least one of the first flow guiding pipe members (101) and the interior of the at least one of the second flow guiding pipe members (201) and a second spiral flow guiding sheet structure (111) is installed at the interior of the at least one of the first flow guiding pipe member (101), wherein the first spiral flow guiding sheet structure (222) and the second spiral flow guiding sheet structure (111) have a different spiral direction.

* * * * *